United States Patent [19]

Kulde

[11] 3,936,891

[45] Feb. 10, 1976

[54] SHOWER SPRAY MASSAGE-SAUNA

[76] Inventor: Harry H. Kulde, 21851 Newland St. No. 248, Huntington Beach, Calif. 92646

[22] Filed: Oct. 11, 1973

[21] Appl. No.: 405,685

[52] U.S. Cl. ..... 4/145; 4/6; 4/160; 4/7; 4/161; 4/162

[51] Int. Cl.[2] ..... A47K 3/22; A61H 33/06

[58] Field of Search ..... 4/160–164, 4/145, 146, 148, 149, 152, 153, 154, 6, 7; 128/365, 366, 367, 371, 372, 374

[56] References Cited

UNITED STATES PATENTS

| | | | |
|---|---|---|---|
| 641,353 | 1/1900 | Wygal | 4/164 |
| 757,933 | 4/1904 | Lindendoll et al. | 4/161 |
| 803,598 | 11/1905 | Jackson | 4/154 |
| 1,092,699 | 4/1914 | Depenbrock | 4/164 |
| 2,380,665 | 7/1945 | Morris | 4/153 |
| 3,581,315 | 8/1968 | Milliner | 4/164 |

*Primary Examiner*—Henry K. Artis

[57] ABSTRACT

Shower Spray Massage-Sauna equipment suitable for installation into existing bathrooms by adding a water diverter valve between the shower head and the shower arm pipe and using a connecting hose to direct the water from the shower head to the Shower Spray Massage-Sauna spray arm. This spray arm is mounted on the wall opposite to the shower water control valves to allow the user to sit on a seat and to control the temperature and the force of the water. This spray arm also supports the flexible body enclosing cover and is adjustable to suit the height of the person using it. The cover has a round opening for the head at the top and partable opening at the front to permit the entry and the exit of the user. This equipment can be left in the bathroom in the non-use position or it can be easily removed to allow the normal use of the bathtub or the shower.

5 Claims, 3 Drawing Figures

SHOWER SPRAY MASSAGE-SAUNA

BRIEF SUMMARY OF THE INVENTION

This invention relates to Shower Spray Massage-Sauna and more particularly to easily installed equipment to be used in existing shower and bathrooms utilizing hot water sprayed from the spray arm to create steam and higher temperature under a flexible man-enclosing cover and also using the water force from the spray arm for body massage.

The primary object of this invention is to provide inexpensive Shower Spray Massage-Sauna equipment, combining steam bath with water spray massage, which can be easily installed in any bathroom having existing shower attachment. To avoid the extra cost of prior art steam-making equipment, this invention uses the versatile hot water spray arm to create steam under the body enclosing cover, as hot water is supplied to this arm through the connecting hose and the shower head diverter valve.

Another important object of this invention is the elimination of a structure or a frame normally required for a steam compartment using body enclosing cover. Shower Spray Massage-Sauna spray arm not only supports the body enclosing cover, but the height of the arm is adjustable and it has a non-use position.

A further and no less significant object of the present invention is the ease and quickness a bathroom equipped with Shower Spray Massage-Sauna equipment can be converted to ordinary shower — to bathtub and back to Shower Spray Massage-Sauna use.

One further object of this invention is to utilize the existing bathtub or shower room for Shower Spray Massage-Sauna and to eliminate the extra cost of a separate sauna room. By using the body enclosing cover the steam is retained within the interior of the cover so that the bathroom atmosphere remains relatively dry.

The accompanying drawings and the following detailed description with operating procedures, including the appended claims will fully explain these and other objects and features of the present invention;

Figure 1:
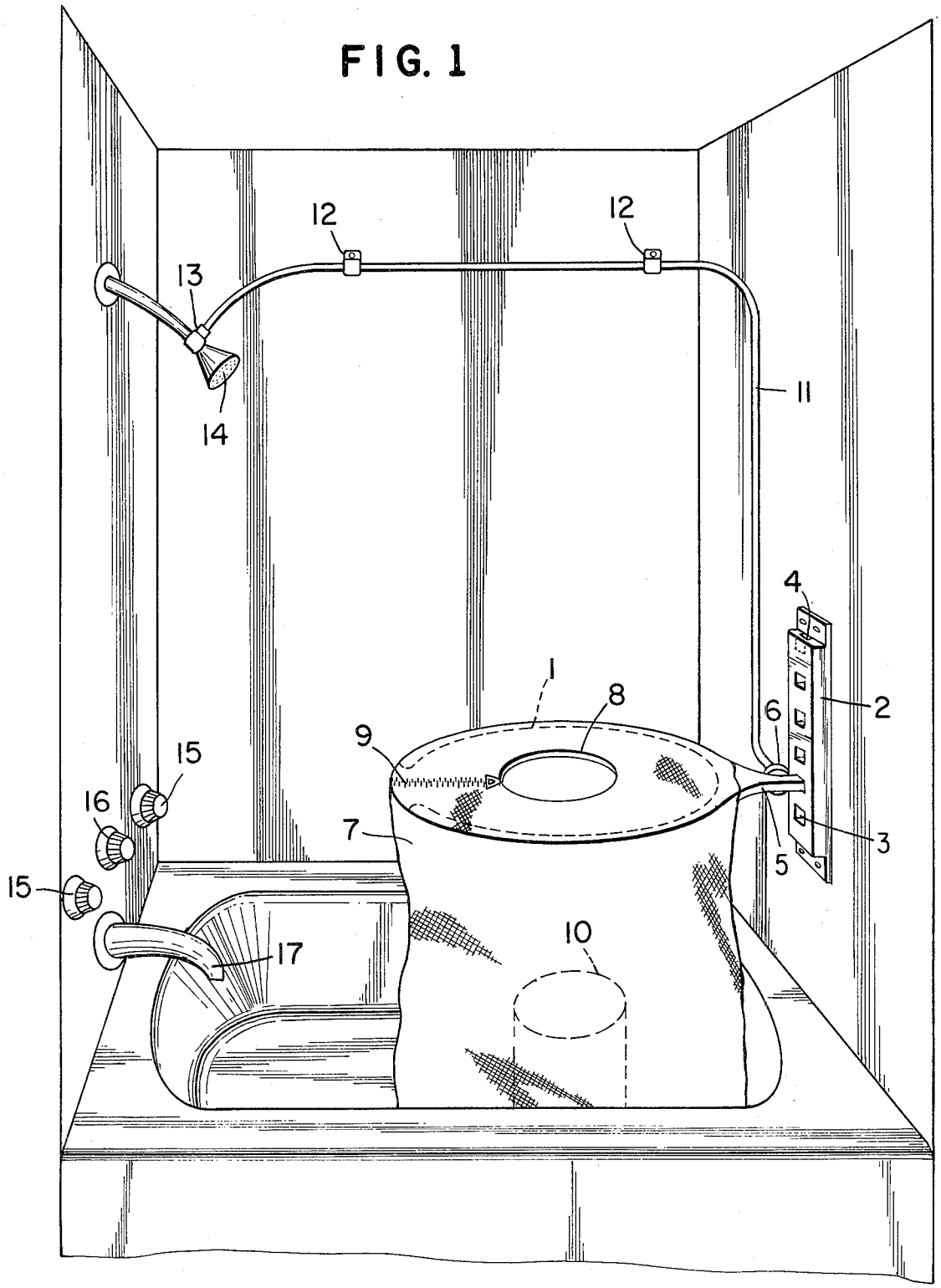
FIG. 1 illustrates the perspective view of Shower Spray Massage-Sauna equipment installed in an existing bathroom with spray arm and the cover in the use position.

FIG. 1 shows a conventional bathroom equipped with Shower Spray Massage-Equipment in ready for use position. The diverter valve 13 is assembled between the shower arm pipe and the shower head 14. A connecting hose 11 to the spray arm 1 is supported by brackets 12 and attached to the spray arm 1 with a coupler 6. The spray arm 1 is supported by the bracket 2, which is mounted on the wall to suit the height of a person using it when sitting on the seat 10. The flexible body enclosing cover 7 is supported by the spray arm 1, has a opening 8 for the users head and a zippered opening 9 at the front to allow the entry and the exit of the user.

Figure 2:
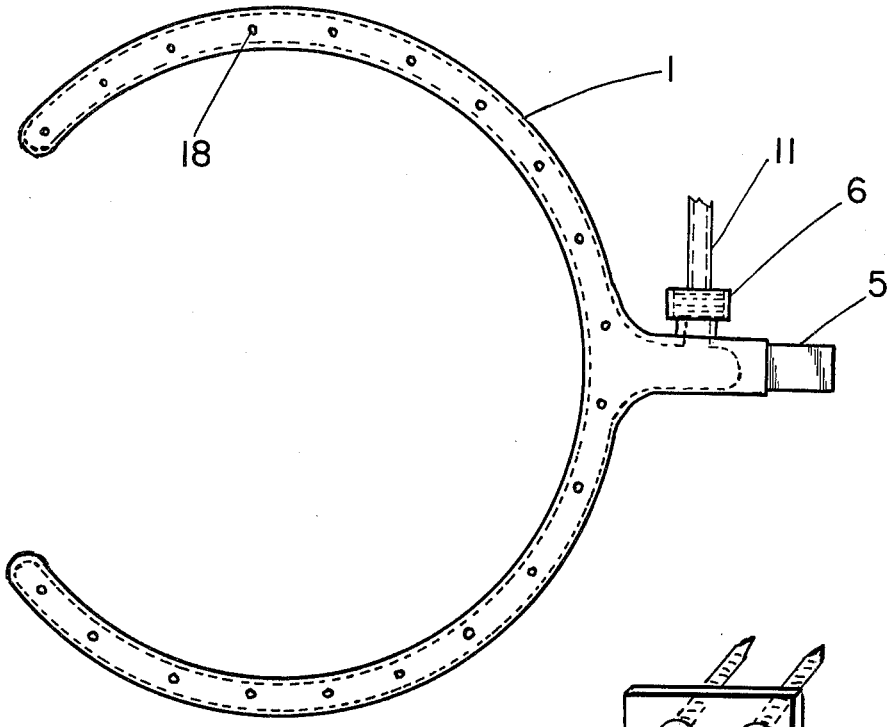
FIG. 2 is the plan view of the spray arm.

The spray arm 1 shown on FIG. 2 has a number of holes 18 for the water spray located so that the spray is directed to every part of the users body. The total number and the size of the holes 18 determines the spray force and the fineness.

Figure 3:
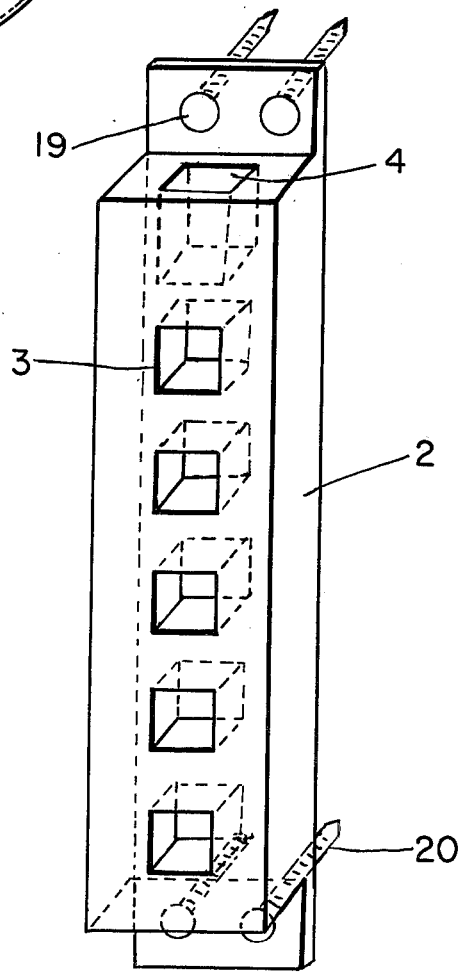
FIG. 3 is the perspective view of the spray arm support bracket.

The support bracket 2 shown in FIG. 3 has holes 19 for the screws or toggle bolts 20, which are used for mounting the bracket 2 on the bathroom wall.

The following procedure is used to operate Shower Spray Massage-Sauna: The first step is to select the right hole 3 in the support bracket 2 to suit the persons height. The correct position for the spray arm 1 is approximately 2 inches higher than the users shoulders, when sitting on the seat 10. The spray arm extension 5 is then pressed into the selected hole 3. The next step is to turn the hot and cold water valves 15 on and to adjust the water temperature, at this time flowing from the bath tap 17, to suit the individual user. As soon as a suitable and stable temperature is reached, the shower water diverter valve 16 is turned to direct the water to the shower head. Then the water diverter valve 13 to the spray arm 1 is turned on to direct the water to Shower Spray Massage-Sauna spray arm 1. The Shower Spray Massage-Sauna is now ready for the user to enter the shower compartment by opening the zipper 9 in the cover 7 and sitting on the seat 10, fully closing the zipper 9 from the inside. The users head is outside the cover 7 through the opening 8 and, if preferred, a towel around the neck of the user can be added to keep the hair dry. The user controls the water temperature and the force by lifting the cover 7 or opening the zipper 9 and adjusting the hot and cold water valves 15 to suit the individual needs.

To convert the Shower Spray Massage-Sauna back to ordinary shower or bathtub use, first the hot and cold water control valves are turned off, then the spray arm 1 is removed from the hole 3 and the extension 5 is pressed into hole 4. In this non-use position the spray arm 1 and the cover 7 are close to the bathroom wall and the cover 7 hangs loosely to permit the drying of the flexible material. The loose seat 10 is removed from the tub and the diverter valves 13 and 16 are turned to shower 14 or bathtub use. If preferred, the spray arm 1, the cover 7 and the hose 11 can be unscrewed from the diverter valve 13 and removed from the bathroom.

The above-described invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are therefore to be embraced therein.

For example, FIG. 2 illustrates a versatile horseshoe shaped spray arm pipe means, however the shape of this spray arm could be rectangular, square, etc. FIG. 3 illustrates the bracket with several holes used for height adjustment and a non-use position for the spray arm. The same function is achieved by using a support clamp sliding along a vertical rod which is mounted on the wall and has a pivoted non-use position for the spray arm. The spray arm is attached to the clamp using threads or other method. The connecting hose from the shower head diverter valve to the spray arm is fixed to the wall by small supporting brackets or could be alternatevily left loose during use and lifted to supporting hooks on the wall in the non-use position. The body enclosing cover can be opened and closed with a zipper or press studs or any other means.

What I claim and desire to secure by United States Letters Patent is:

1. In a shower spray massage sauna for use in a bathroom comprising, in combination, a diverter valve installed between a shower head and a shower arm pipe, means introducing hot water from the shower arm pipe to the diverter valve by manipulating shower water control valves associated therewith, means directing hot water through the diverter valve and the connecting hose to said spray arm pipe means, said hose connects the diverter valve to the spray arm pipe means, said spray arm pipe means supports a body enclosing cover and is located inside said cover, means introducing the hot water spray under the cover, means combining inside the cover the force from the water for massage and the hot water spray for sauna, said cover adapted to assume a use or a non-use position, said spray arm pipe means supported and held in either position by a mounting mechanism attached to the wall, and in the use position a seat is placed inside the body enclosing cover.

2. In a shower spray massage sauna as defined in claim 1 wherein the spray arm pipe means adapted to assume either a use or a non-use position and means permitting easy bathroom conversion from conventional use to shower spray massage sauna use.

3. In a shower spray massage sauna as defined in claim 1 wherein the body enclosing cover means incorporates an opening at the top and a partable opening at the side to allow ingress and egress of the user.

4. In a shower spray massage sauna as defined in claim 1 wherein the spray arm pipe means determines the water spray fineness and the direction of spray.

5. In a shower spray massage sauna as defined in claim 1 wherein the water pressure for the massage and the water temperature for the sauna are adjustable.

* * * * *